US005375514A

United States Patent [19]

Dann, Jr.

[11] Patent Number: 5,375,514

[45] Date of Patent: Dec. 27, 1994

[54] ADJUSTABLE HEIGHT TABLE SUPPORT MECHANISM

[76] Inventor: Herbert I. Dann, Jr., 1559 Riff Rd., Corning, N.Y. 14830

[21] Appl. No.: 73,102

[22] Filed: Jun. 7, 1993

[51] Int. Cl.[5] ..... A47B 9/00

[52] U.S. Cl. ..... 108/145; 108/72

[58] Field of Search ..... 108/72, 71, 73, 83, 108/65, 66, 93, 96, 9, 145; 248/421

[56] References Cited

U.S. PATENT DOCUMENTS

| | | | |
|---|---|---|---|
| 651,638 | 6/1900 | Norris | 108/145 |
| 773,379 | 11/1904 | Mitchell | 108/72 |
| 1,689,445 | 10/1928 | Merriman . | |
| 1,728,917 | 9/1929 | Anderson | 108/72 |
| 2,170,098 | 8/1939 | Stephenson . | |
| 2,566,668 | 9/1951 | Krueger | 108/145 X |
| 2,585,535 | 2/1952 | Carlsson . | |
| 2,630,359 | 3/1953 | Schade | 108/145 X |
| 2,727,799 | 12/1955 | Keal . | |
| 3,347,184 | 10/1967 | Kiraly . | |
| 4,109,588 | 8/1978 | Powers . | |
| 4,836,114 | 6/1989 | Cohen et al. | 108/66 X |

FOREIGN PATENT DOCUMENTS

| | | | |
|---|---|---|---|
| 68486 | 1/1949 | Denmark | 108/145 |
| 117292 | 9/1946 | Sweden | 108/146 |
| 125225 | 1/1950 | Sweden | 108/145 |

OTHER PUBLICATIONS

Carroll, B. and McIntosh J., Movable Tops Lifting Occasional Table Sales, Furniture/Today, May 10, 1993, pp. 9 and 12.

*Primary Examiner*—Jose V. Chen

*Attorney, Agent, or Firm*—Barnard, Brown & Michaels

[57] ABSTRACT

A mechanism for dual-height tables, counters, or the like, in which the top lifts and pivots upward and outward on pairs of links attached to the top and to link housings attached to the table or counter base. Each pair of links comprises a pivot link and a locking link. The pivot link has holes at each end which ride on pins or the like attached to a bracket on the top and the pivot link housing on the bottom. The locking link is similarly arranged at the top, with a hole for a pin attached to a bracket. The bottom end of the locking link has an elongated slot, through which a pin is inserted to fasten the locking link to the locking link housing. When the top is in the lowered position, the pin is in the end of the slot closest to the end of the locking link. As the top is raised, both links pivot on the pins in the link housings. When the top has reached its most-forward pivot position, the locking link rests on a forward stop. The locking link is then slid downward into a locking pocket in its housing, the pin moving upward in the slot until it rests on the top of the slot and the top of the table is horizontal. At this point the top is rigidly supported and locked in the forward/upward position.

14 Claims, 5 Drawing Sheets

ADJUSTABLE HEIGHT TABLE SUPPORT MECHANISM

FIELD OF THE INVENTION

The invention pertains to the field of vertically adjustable supports for horizontal planar surfaces. More particularly, the invention pertains to supporting mechanisms for tables, counter tops, or the like where the top of the table or counter or the like is vertically adjustable between two positions on a plurality of pivoting links.

BACKGROUND OF THE INVENTION

Recent studies have shown that a large portion of the American public prefers to eat in front of the TV set. While snack tables or the like have long been available for this activity, consumers have felt a need for more permanent and sturdy tables which, at the same time, will not get in the way of other activities in the same room at other times.

Changes in lifestyles over the years have made consumers more demanding of multiple functions from furniture. This has led to the popularity of sofa/recliners, "home theater" systems, etc. A cocktail table which can convert to an eating surface would be a useful and popular addition to the list. The top of such a table would have to lift up and out, so that it would be suspended over the legs of a person seated on a sofa or chair.

This same adjustable approach would be equally useful for cocktail tables in business waiting rooms or offices which could convert to work surfaces, or to sections of counter top in small kitchens which would lift up and out to facilitate use by cooks seated on stools.

Convertible tables are known to the art. However, the mechanisms for such furniture are typically complicated and expensive, and often are less than sturdy enough to want to trust. It is thus an object of the invention to provide a mechanism for dual-height tables which is simple to build and use, inexpensive, and sturdy.

Several companies have begun to sell occasional tables with movable tops recently (see "Movable Tops Lifting Sales of Occasional Tables", *Furniture Today*, May 10, 1993, pp.9 and 12). To the best of the inventor's knowledge, the mechanisms for the tables being currently sold are either of the swivel or pivot kind, or are basically on the same kind of scissor leg mechanism as is used in recliner footrests.

The following patents are considered relevant to the state of the art:

Merrimen, U.S. Pat. No. 1,689,445 shows an ironing board/table. The mechanism uses parallel links with a slotted lever used to raise and lower the surface and lock it into place. The table top slides out of the way to allow the ironing board to be raised.

Stephenson, U.S. Pat. No. 2,170,098 shows a desk with a raisable top. The top is supported on two links, one of which is bent in a dog-leg shape. Springs are used to bias the links into position. The links function in an over-the-top action, whereby when the top is fully raised, the legs are over the center of balance, which tends to hold the top open. However, there is nothing locking the top in this position, and pushing on the top in a rearward direction would push the links back over the top of rotation, leading to the collapse of the top.

Carlsson, U.S. Pat. No. 2,585,535 shows a table having a vertically adjustable top. The mechanism uses a leaf spring to raise the top and a set of props to hold it in raised position. The top does not extend outwardly as it raises, although sections of the top may be slid on rails to allow insertion of a leaf. In fact, sliding the top sections outward releases the top mechanism, allowing it to lower.

Keal, U.S. Pat. No. 2,727,799 shows a table with an adjustable top which pivots up and to the side, like that of the present invention. The parallel links supporting the top do not go over center, an inherently unstable arrangement, and require a locking bar to hold them in place.

Kiraly, U.S. Pat. No. 3,347,184 also shows a table with a section which lifts up and out (to form a lectern, in this case). Kiraly's support links are locked by a multiple-slotted locking bar which allows the lectern top to be locked in several positions. The design is not adapted to supporting any weight on the lectern top, and the multiple positions of the locking bar are, at best, centered on the links—all other positions have both links to the weak side of center (i.e. the locking bar is what keeps the lectern from collapsing, not the inherent stability of the configuration.

Powers, U.S. Pat. No. 4,109,588 shows a cocktail type table in which four non-parallel links are pivoted at the center of the base of the table, forming a pedestal when the top is raised and a key member is inserted.

SUMMARY OF THE INVENTION

The invention provides a mechanism for dual-height tables, counters, or the like, in which the top lifts and pivots upward and outward on pairs of links attached to the top and to housings for the links attached to the table or counter base frame. The top locks firmly into place in the outward/upward position without springs, lock bars or other additional elements.

Each pair of links comprises a pivot link and a locking link.

The pivot link has holes at each end which ride on pins or the like attached to a link bracket on the top and the pivot link housing on the bottom.

The locking link is similarly arranged at the top, with a hole for a pin attached to a link bracket. The bottom end of the locking link has an elongated slot, through which a pin is inserted to fasten the locking link to the locking link housing.

When the top is in the lowered position, the pin is in the end of the slot closest to the lower end of the locking link. As the top is raised, both links pivot on the pins in the two link housings. When the top has reached its most-forward pivot position, the locking link rests on a forward stop in the locking link housing. The locking link is then slid downward into a locking pocket in the locking link housing, the pin moving upward in the slot until it rests on the top of the slot and the top of the table is horizontal. At this point the top is rigidly supported and locked in the forward/upward position without the need for locking bars, levers or other mechanisms.

The top may be put into its lowered position by simply lifting the locking link out of the pocket until the pin has reached the bottom of the slot, then pivoting the links back into the lowered position.

DESCRIPTION OF THE PREFERRED EMBODIMENT

Figure 1:
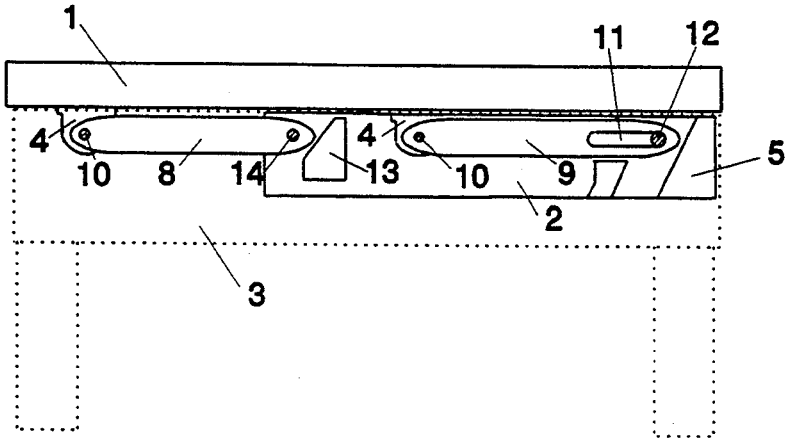
FIG. 1 shows the mechanism of the invention, with the table surface in a lowered position.
Figure 2:
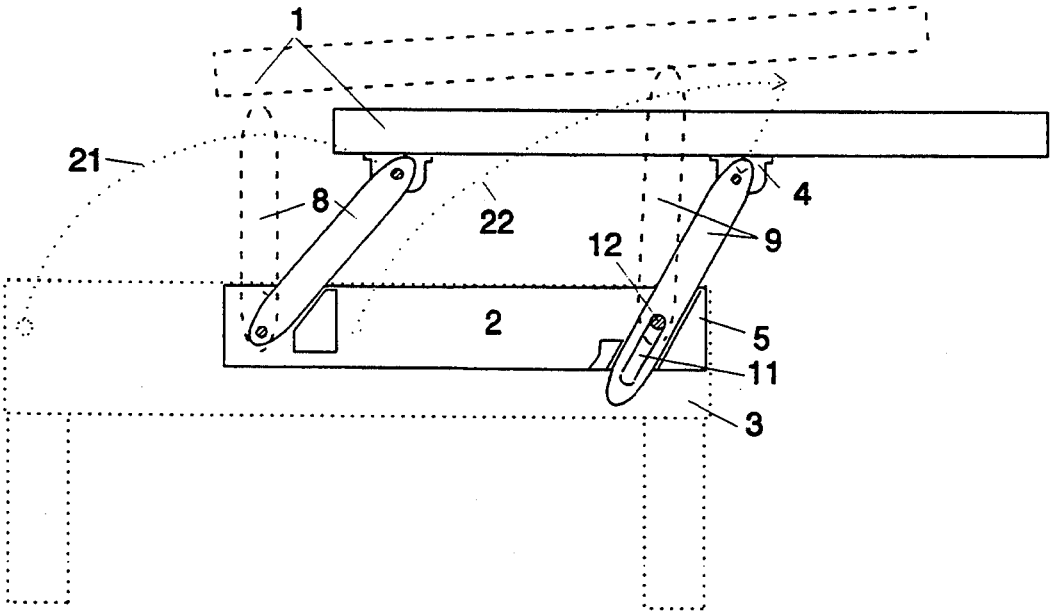
FIG. 2 shows the mechanism of the invention, with the table surface in a raised position.

FIGS. 1 and 2 show the invention, as it would be installed in a table with a raisable top. In order to make the features of the invention clearer, various parts of the table and mechanism have been omitted or cut away, and only a single support is shown. The locking link and associated parts of the link housings are shown in FIGS. 6–8 and 11. In all figures, identical reference numbers denote identical features.

FIG. 1 shows the invention in a table with the top (1) in its lowered position. Although only one support mechanism is shown in the figures, it will be understood that an actual table would require at least two such mechanisms, at opposite sides of each moveable top panel.

The support mechanism of the invention comprises a mounting frame, to which is attached the locking link housing (5) and pivot link housing which support the lower ends of the two links (8) and (9), and which are attached to the support frame (3) for the table.

It will be understood that the term "table frame" or "support frame" is meant here to include any part of the table supporting structure, including side members, stringers, cross members, internal bracing, etc., to which the housings (or base plate(s)) can be attached within the teachings of the invention, and is not meant to limit the invention to attachment to any particular part of any particular kind of furniture.

The links are arranged in pairs, one pivot link (8) and one locking link (9) per link mounting assembly. The ends of the links are preferably rounded, so as to pivot around the pivot pins without binding.

The upper ends of both links are fastened to the top (1) by pivot brackets (4), attached to pivot pins (10) passing through holes in the ends of the links. The brackets (4) could be as simple as "L" brackets, or would preferably be in the shape of a "U", supporting the pivot pin (10) on both sides of the link. Alternatively, if the links are thick enough, the end of the links could be slotted, and "T" shaped brackets could fit into the slots, within the teachings of the invention.

The pin (10) itself could be a bolt passing through holes in the pivot brackets (4), or could be a spring pin which snaps into the holes in a "U" shaped pivot bracket, or any other convenient arrangement.

The pivot link (8) is shorter than the locking link (9), and is attached to the base plate (2) by a simple pivot pin (14) passing through a hole in the end of the link (8) and into the base plate. Preferably, a "U" shaped pivot link housing (see FIG. 9, (64)) would hold both ends of this pivot pin around the pivot link. If desired, a stop (13) could be provided. This would prevent the pivot link from excessive travel if excessive weight is put on the top when it is in the fully raised position, but would provide sufficient clearance for the pivot link to move while the top is in normal operation, allowing the locking link to travel in its longer arc (as described below) when locking or unlocking in the locking pocket. If desired, the stop could be formed as part of the lower pivot link housing.

Figure 6:
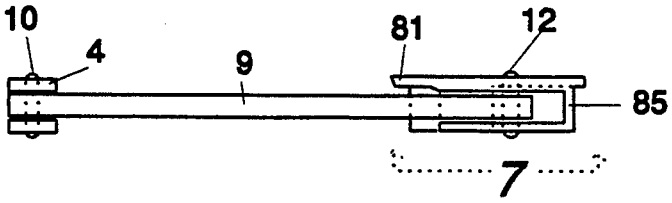
FIG. 6 shows a top view of the locking link with locking link housing and link bracket, in the independent housing embodiment.
Figure 6A:
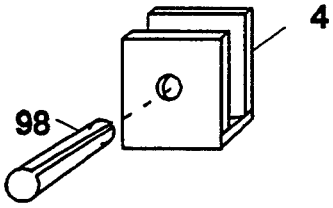
FIG. 6*a* shows an isometric view of a pivot bracket with a spring pin used as a pivot pin.
Figure 7:
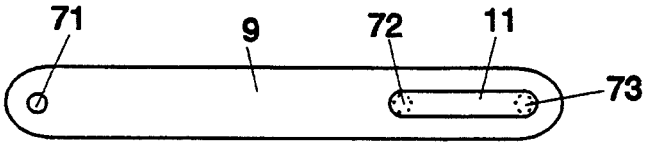
FIG. 7 shows a side view of the locking link.

FIG. 6*a* shows how a spring pin (98) can be used as a pivot pin, in an isometric view of the pivot bracket (4).

Figure 11:
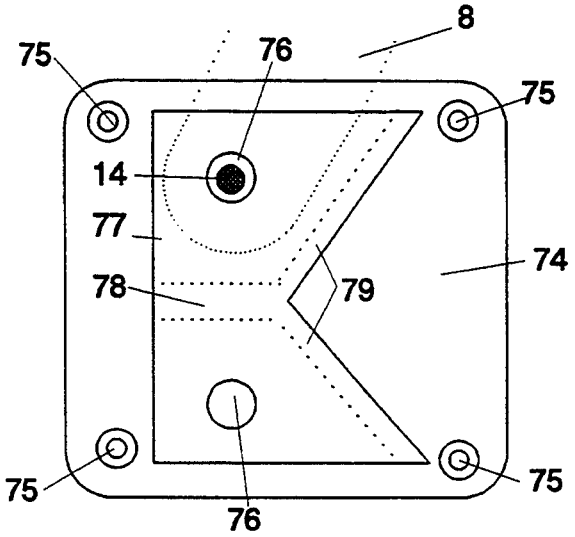
FIG. 11 shows a detailed side view of the pivot link housing, as used in an independent housing embodiment.

FIG. 11 shows a detailed side view of a pivot link housing, of the kind used in the independent housing embodiment of the invention. A base plate (74) is provided for mounting the pivot link housing to the frame, preferably by means of holes (75) for self-tapping screws passing into the frame. The housing holds the pivot link (8) by a pivot pin (14) passing through a hole (76) in the housing (77) and the base plate (74). As shown by the dotted lines, the housing is open on the top and side, and has a solid webbing (78) for support in the middle. A slanted portion of the webbing (79), forms the pivot link stop, discussed above.

The embodiment of the pivot link housing shown in FIG. 11 is symmetrical about a horizontal axis passing through the housing at its middle, which allows the housing to be mounted on either side of the frame. That is, if the pivot and locking link housings are to be mounted on the same side of the frame, the pivot link housing would be used as shown. If it is to be on the opposite side from the locking link housing, the pivot link housing could be inverted, and the other hole (76) and stop (79) used.

The locking link (9) and its locking link housing (5), and the arrangement of the links and pivot points, are the heart of the invention. See FIG. 7 for details of the locking link, FIG. 8 for details of the locking link housing, and FIG. 2 (dotted lines) for the paths of the links as the invention is operated.

The locking link (9) is longer than the pivot link (8), with a slot (11), rather than a simple hole, in the lower end.

The lengths of each of the links, and the distance on the locking link between each end of the slot and the other pivot hole, are important to the operation of the invention. The distance between the pivot hole (71) in the upper end of the locking link and the upper end of the slot (72) is selected so that the top of the table will be horizontal (or at the desired angle from the horizontal, if a non-horizontal surface is required for some reason) when pivot pin (12) is resting in the top of the slot, as shown in FIG. 2. This slot-to-pivot distance, and the lengths of both links, are selected such that the locking link may travel uninterrupted to its highest position (as shown by the dotted lines in FIG. 2) when raising or lowering the surface. If the various lengths are not selected properly, the movement will tend to bind up as the links travel their different eccentric arcs.

The lower end of the slot (73) is located so that pivot pin (12) will form a pivot against the lower end when the top (1) is in the lowered position, as shown in FIG. 1.

Figure 8:
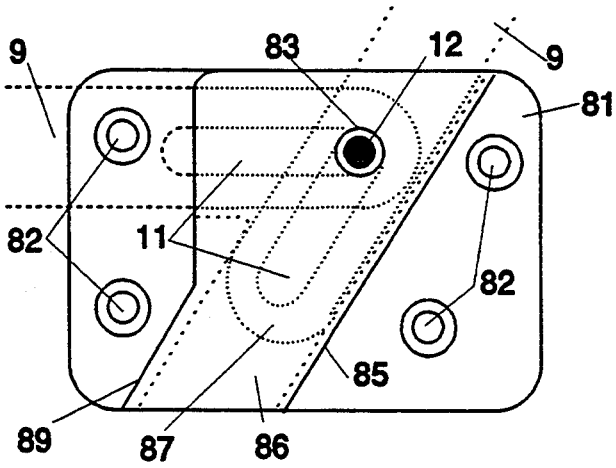
FIG. 8 shows a detailed side view of the locking link housing, as used in an independent housing embodiment.

The locking link (9) is held at its lower end by a locking link housing (5), which preferably surrounds the lower end of the locking link (9). FIG. 8 shows the details of this locking link housing (as it would appear in an embodiment where the mounting frame and link housings are manufactured in independent parts), and FIG. 6 shows the same housing, with the link, from the top. The locking link housing has a base portion (81) for mounting to the frame. Preferably a number of holes for screws (82) are provided, which allows the locking link housing to be attached to the frame by self-tapping screws. The locking link housing has a hole (83) for pivot pin (12) around which the locking link (9) pivots (the locking link is shown in dotted lines in FIG. 8).

Referring to FIG. 8, it will be seen that when the top is in the lowered position, locking link (9) is horizontal, with the pivot pin (12) at the bottom end of the slot (11). When the locking link is in the raised position, the pivot pin (12) is in the upper end of the slot (11). At the same time, the locking link (9) rests against a stop (85), with the lower end of the link (87) in a locking pocket (86) formed by the stop (85) and the inner portion of the locking link housing (89).

As can be seen in FIG. 2, when the top (1) is raised from its lowered (FIG. 1) to raised (FIG. 2) position, the ends of the pivot link (8) and locking link (9) describe dotted paths (21) and (22–23), respectively. That is, pivot link (8) simply pivots upward in an arc (21), due to the arrangement of pivot links in holes. Locking link (9), however, follows a different path—first an arc (22) as the locking link pivots on pivot pin (12), then straight down (23) as the link hits stop (85) and pivot pin (12) moves through slot (11) and the locking link (9) slides into the locking pocket (86), locking firmly in place.

The two links are not parallel when the top is in the fully raised position. The exact angle of each link will be chosen within the teachings of the invention, depending on whether the designer wishes the top to rest primarily higher than the lowered position (as might be used in the cocktail table application of FIG. 3)) or primarily forward of the lower position (as might be used in the counter application of FIG. 4). In the cocktail table application, the pivot link will preferably describe an angle of approximately 35° from the vertical, with the locking link at approximately 30°. As the resting position of the raised top is moved forward (lower), the angle from the vertical increases, with the counter application pivot link at approximately 45° and 40° for the locking link.

Both links are over center when the top is in its raised position, with the locking link resting against its stop, which provides stability. The action of the locking link in its pocket keeps the top from collapsing if the surface is pushed rearward.

Figure 9:
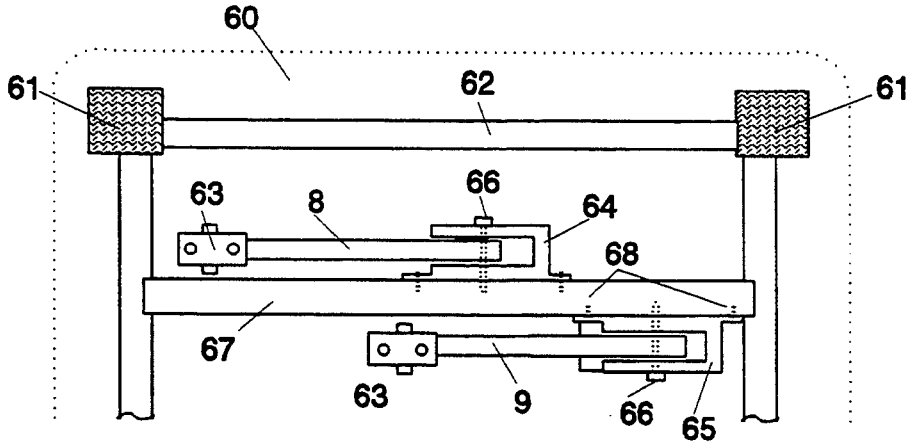
FIG. 9 shows a top view of part of a table with the invention used in an independent housing embodiment, showing overlap of pivot and locking links.
Figure 10:
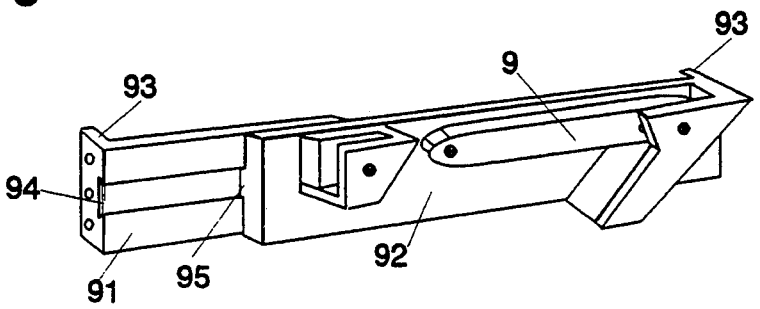
FIG. 10 shows an adjustable link mounting assembly embodiment of the invention, adapted to be incorporated into existing table designs, using an integrated housing embodiment.

There are two major alternate arrangements for the mechanism invention, in regard to how the housings for the pivot and locking link are formed: an integrated housing arrangement, where the pivot link housing and locking link housing are made as one integrated assembly (as shown in FIGS. 1, 2 and 10); and an arrangement where the pivot link and locking housings are formed as independent parts, attached to the support frame (as shown in FIGS. 5, 6, 8, 9 and 11). In both cases, the housings are "attached to" the support frame, as claimed below, but in one embodiment it is contemplated that the housings will be manufactured separately with separate base plates for attachment to the housing, and in the other they will be manufactured on a common base plate.

The advantage to the independent housing embodiment is that it will allow the invention to be used in furniture where there is insufficient length of the part of the support frame, such as a table cross-member, to which the housings will be attached to permit the two housings to be mounted on the same side of the support frame cross-member. A single assembly of this kind (two or more would be used in the full table) is shown in top view detail in FIG. 9. In that figure, the table top (60) is shown in dotted lines. The table frame (62) is supported by legs (61), and a cross-member (67) is attached side rails of the frame (62) by being inset as shown. The mechanism is attached to the top by upper pivot brackets (63) attached to the pivot link (8) and locking link (9) by pivot pins as described above. The pivot link housing (64) is attached to one side of the cross-member (67), and the locking link housing (65) is attached to the opposite side. The two housings are attached using any conventional means, such as screws (68). If desired, for additional strength, the lower pivot pins (66) can be in the form of lag bolts which pass through the housings, forming the pivot pins, then screw into the cross-member (67). This arrangement is shown in FIG. 9.

An embodiment of the invention as shown in FIG. 10 could be provided for retrofit into existing furniture designs, or for inclusion into new designs, replacing the need for cross-members in the table frame to which the housings are attached. In such an application, the housings are integrated onto a base plate made in two sections (91) and (92) which can slideably extend the length of the base plate to fit any frame desired. This can be accomplished as shown by having a dovetail (95) on one half of the base plate matching with a dovetail slot (94) on the other half. The extendable base plate is fit into the frame of the table by sliding the base plate halves (91) and (92) until flanges (93) can be fastened into the frame. The table top is mounted to the same design pivot brackets (4) as shown in FIGS. 1, 2 and 6. It will be noted that this figure shows the integrated housing embodiment discussed above.

Figure 3:
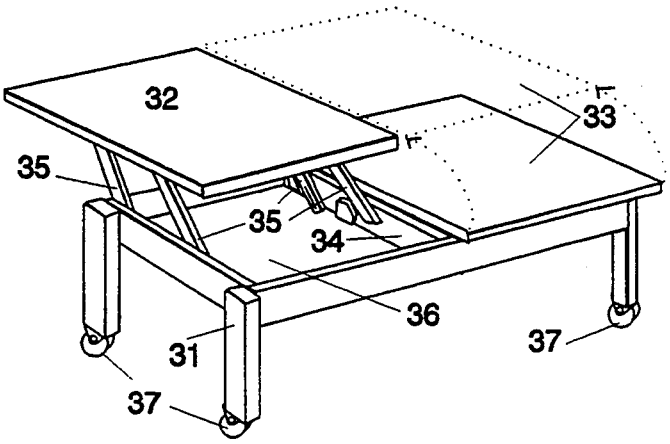
FIG. 3 shows the invention as embodied in a table with multiple vertically-adjustable panels.

FIG. 3 shows the mechanism of the invention embodied into a cocktail table. The cocktail table has a frame (31) with legs to support the table. The preferred embodiment of the invention has a top split into two sections (32) and (33), which can be raised independently as shown in the figure, although a single top version could be made within the teachings of the invention, depending on the designer's requirements. The mechanism of the invention would be built into the table in the form of four link mounting assemblies (34) with associated links (35), two link mounting assemblies and two pairs of links per top.

The independent top sections could be designed within the teachings of the invention to lift to the same side of the table, as shown, or to opposite sides, or to the ends, or some combination of these, as the requirements of the application would dictate.

To facilitate the ease of using the table with the surface raised, a shelf (36) may be provided below the frame or cross-members, to allow storage of the items from the table top when it is raised. Also, the table legs may have casters (37) on their ends, to easily move the table over the knees of the user when in the seated position.

Figure 12:
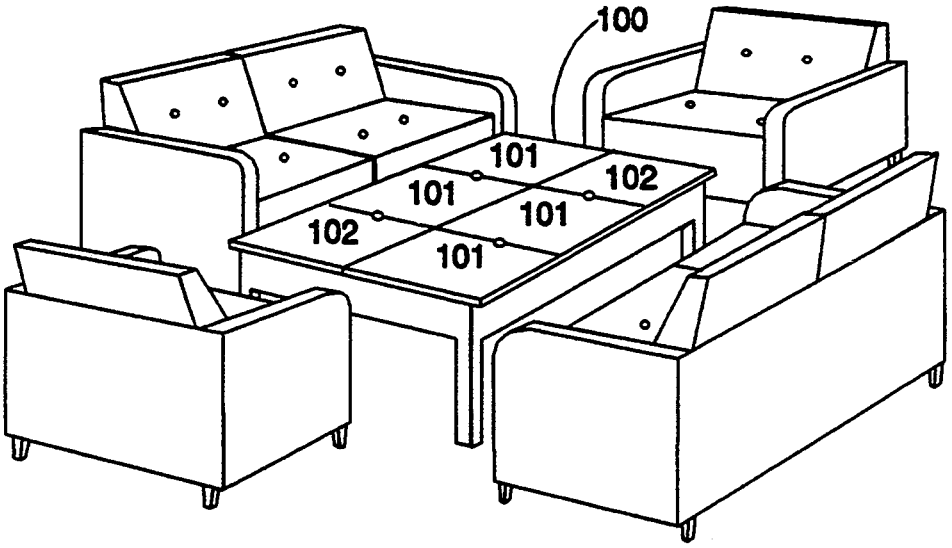
FIG. 12 shows the invention embodied in a six-section cocktail table.

It will be understood by one skilled in the art that additional link mounting assemblies could be added for additional support in special applications. Also, a square cocktail table could be built with four top sections, lifting up and outward similarly to the two-section rectangular table shown in the figure. Or, (FIG. 12) a six-section rectangular cocktail table (100), with sections moving up and to the sides (101) and ends (102), can be built which will convert into a conference table, accommodating seating when the top sections are raised.

Figure 5:
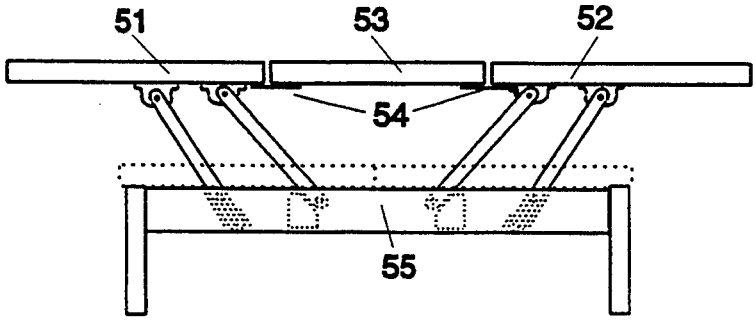
FIG. 5 shows the invention as embodied in a table having an insertable leaf between two vertically adjustable top sections.

FIG. 5 shows how the invention could be used in a low table which converts into a higher table with a larger top. A two-section table (55) similar to the one in FIG. 3 would be arranged so that the two sections (51) and (52) lift up and outward toward the ends, rather than toward the side as in FIG. 3. When lowered (dotted lines), the two sections form a single low table surface. When raised, the gap between the two sections (51) and (52) is filled with a leaf (53) which rests on supports (54) which extend inwardly from the inward ends of the two top sections, forming a large top suitable for use as a dining table. Preferably, an overlapping arrangement such as shown in FIG. 9 would be used here, to allow for a minimum of link mounting assembly length and a maximum of lift.

Figure 4:
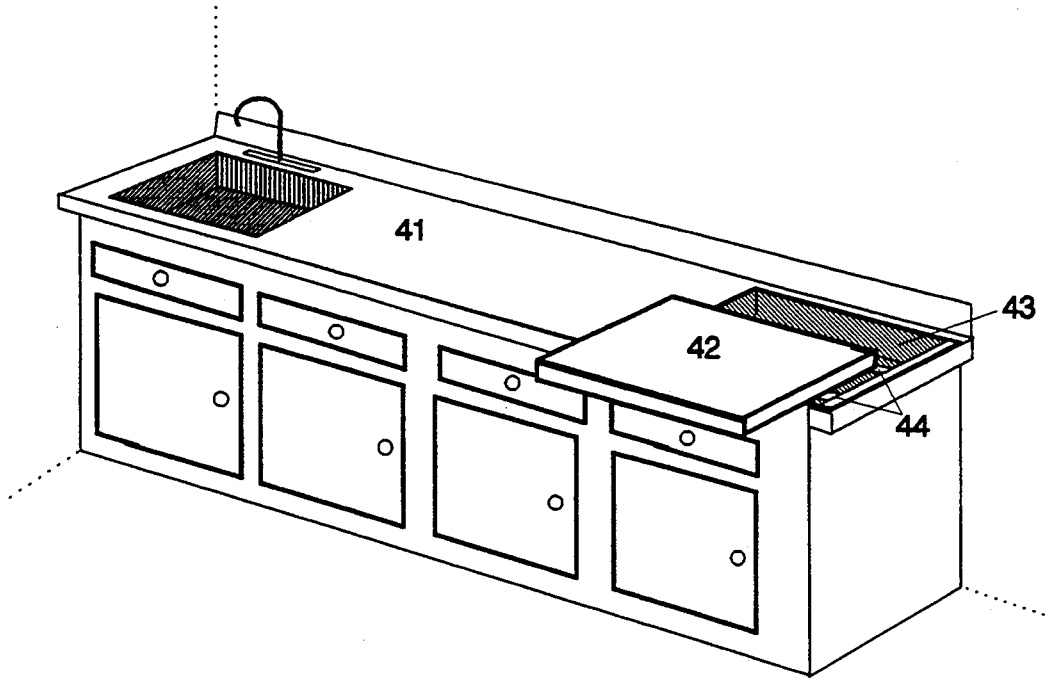
FIG. 4 shows the invention as embodied in a counter having a vertically adjustable work surface.

The mechanism of the invention is also useful in a counter embodiment, as shown in FIG. 4. A kitchen counter (41) can be equipped with a moveable section (42) sunk into a cut-out (43) supported by the link mounting assembly and links (44) of the invention. This would allow the section of counter to be pulled upward and outward to serve as a work surface for a cook sitting on a stool. Because the link mounting assemblies will be fastened to the cabinet, which is heavy and preferably attached to the wall, the surface (42) can be cantilevered out farther than would be stable in a cocktail table embodiment by allowing the links to form a greater angle from the vertical, as discussed above.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. A mechanism for adjustably supporting a planar surface in a raised or lowered position over a support frame, comprising:

a) a locking link housing attached to the support frame, having pivot pin means for pivotally holding the end of a link by passing through a slot therein, stop means for preventing a link pivoted on the pivot pin means from pivoting beyond a chosen vertical angle; and pocket means for holding a link against pivoting, located in the locking link housing relative to the pivot pin means such that when the link is pivoted on the pivot pin and is stopped by the stop means at the chosen vertical angle., the link is aligned with the pocket means;

b) pivot link housing means for pivotally holding an end of a pivot link, attached to the support frame, having pivot pin means for pivotally holding the link in the pivot link housing by passing through a hole in said link and through said pivot link housing means;

c) an elongated pivot link, having holes adjacent to each end thereof, one end of the pivot link being pivotally attached to the pivot link housing means by having the pivot pin means of the pivot link housing means pass through the hole therein, such that the pivot link is movable from a first lowered position to a second raised position by pivoting said link on said pivot pin means of the pivot link housing means;

d) an elongated locking link, having a hole adjacent one end, and a slot adjacent the other end, the end of the locking link having the slot being pivotally and slideably attached to the locking link housing by having the pivot pin means of the locking link housing pass through the slot therein, such that the locking link is movable from a first lowered position to a second raised locked position by pivoting the link on the pivot pin when said pin is in the end of the slot nearest the end of the link until the locking link rests on the stop means of the locking link housing, then lowering the end of said link into the pocket means of the locking link housing by sliding said pivot pin through said slot until said pivot means rests on the opposite end of said slot;

e) a first bracket means, pivotally attached to the pivot link by a pivot pin means passing through the hole in said pivot link adjacent to the end opposite the end attached to the pivot link housing, having means for attaching the first bracket means to the planar surface;

f) a second bracket means, pivotally attached to the locking link by a pivot pin means passing through the hole in said locking link, having means for attaching the second bracket means to the planar surface;

such that when the pivot link housing and locking link housing are attached to the support frame and the first and second brackets are attached to the planar surface, the planar surface is movable from a first, lower position to a second, higher position and locked in place in said higher position by pivoting the pivot link and locking link from their first position to their second position, then lowering the locking link into the pocket means of the locking link housing.

2. The mechanism of claim 1, further comprising mounting frame means for attachment to the support frame, such that the pivot link housing and locking link housing are attached to the mounting frame means, and the mounting frame means is attached to the support frame, the mounting frame means being of adjustable length to fit support frames of varying size.

3. The mechanism of claim 1, in which the pivot link and the locking link are not parallel when in their second, raised position.

4. The mechanism of claim 1, further comprising second stop means attached to the support frame, positioned sufficiently close to the pivot link housing means that the second stop means will contact the pivot link to prevent the pivot link from excessive travel if excessive weight is applied to the surface when in the raised position, but sufficiently far from the pivot link housing means to allow the pivot link to move forward when the locking link is being raised to unlock the locking link from the locking pocket.

5. The mechanism of claim 1, in which the pivot link makes an angle in the range of 35° to 45° from the vertical when in its second, raised position.

6. The mechanism of claim 1, in which the locking link makes an angle in the range of 30° to 40° from the vertical when in its second, raised position.

7. The mechanism of claim 1, in which the pivot pin means are spring pins.

8. The mechanism of claim 1, in which the mounting frame, pivot link housing and locking link housing are formed as one integrated unit on an elongated base means for mounting to the support frame.

9. The mechanism of claim 1, further comprising a support frame, in which the pivot link housing and locking link housing are attached to opposite sides of the support frame, and the locking link and pivot link overlap horizontally when the surface is in the lowered position.

10. An adjustable height table, comprising:

a) a table frame;

b) a top with one or more sections;

c) a plurality of riser mechanisms, at least two per top section, attached to the frame and the top, comprising:

i) a locking link housing attached to the table frame, having pivot pin means for pivotally holding the end of a link by passing through a slot therein, stop means for preventing a link pivoted on the pivot pin means from pivoting beyond a chosen vertical angle; and pocket means for holding a link against pivoting, located in the locking link housing relative to the pivot pin means such that when the link is pivoted on the pivot pin and is stopped by the stop means at the chosen vertical angle, the link is aligned with the pocket means;

ii) pivot link housing means for pivotally holding an end of a pivot link, attached to the table frame, having pivot pin means for pivotally holding the link in the pivot link housing by passing through a hole in said link and through said pivot link housing means;

iii) an elongated pivot link, having holes adjacent to each end thereof, one end of the pivot link being pivotally attached to the pivot link housing means by having the pivot pin means of the pivot link housing means pass through the hole therein, such that the pivot link is movable from a first lowered position to a second raised position by pivoting said link on said pivot pin means of the pivot link housing means;

iv) an elongated locking link, having a hole adjacent one end, and a slot adjacent the other end, the end of the locking link having the slot being pivotally and slideably attached to the locking link housing by having the pivot pin means of the locking link housing pass through the slot therein, such that the locking link is movable from a first lowered position to a second raised locked position by pivoting the link on the pivot pin when said pin is in the end of the slot nearest the end of the link until the locking link rests on the stop means of the locking link housing, then lowering the end of said link into the pocket means of the locking link housing by sliding said pivot pin through said slot until said pivot means rests on the opposite end of said slot;

v) a first bracket means, pivotally attached to the pivot link by a pivot pin means passing through the hole in said pivot link adjacent to the end opposite the end attached to the pivot link housing, having means for attaching the first bracket means to the planar surface;

vi) a second bracket means, pivotally attached to the locking link by a pivot pin means passing through the hole in said locking link, having means for attaching the second bracket means to the planar surface;

such that the top is movable from a first, lower position to a second, higher position and locked in place in said higher position by pivoting the pivot link and locking link from their first position to their second position, then lowering the locking link into the pocket means of the locking link housing.

11. The adjustable height table of claim 10, in which the table is a square cocktail table and there are four top sections.

12. The adjustable height table of claim 10, in which the table is a rectangular cocktail table, and there are two top sections.

13. The adjustable height table of claim 12, in which the two top sections raise upward and outward toward the ends of the table, and the table further comprises a leaf section, adapted to fit between the inner edges of the two top sections when they are in their raised position, such that the two top sections and the leaf form a continuous raised top.

14. The adjustable height table of claim 10, in which there are six top sections, and the table is a rectangular cocktail table when the top is in the lowered position, and converts to a conference table when the top sections are raised accommodating seating around the table.

* * * * *